US007025014B1

(12) United States Patent
Forgach et al.

(10) Patent No.: US 7,025,014 B1
(45) Date of Patent: Apr. 11, 2006

(54) SEA VESSEL RETRIEVAL OF UNMANNED UNDERWATER VEHICLES

(75) Inventors: Kenneth M Forgach, North Potomac, MD (US); Christos Kasselas, Arlington, VA (US); Emily K. Mayer, Washington, DC (US); Francis M. Mulhern, Riverton, NJ (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/960,718

(22) Filed: Oct. 8, 2004

Related U.S. Application Data

(60) Provisional application No. 60/550,738, filed on Mar. 3, 2004.

(51) Int. Cl.
*B63B 21/66* (2006.01)

(52) U.S. Cl. ..... 114/244; 114/254

(58) Field of Classification Search ..... 114/242, 114/244, 245, 253, 254

See application file for complete search history.

(56) References Cited

U.S. PATENT DOCUMENTS 3,943,875 A * 3/1976 Sanders ..... 114/244
4,588,150 A * 5/1986 Bock et al. ..... 244/172.4
5,447,115 A * 9/1995 Moody ..... 114/312
6,390,012 B1 * 5/2002 Watt et al. ..... 114/322

FOREIGN PATENT DOCUMENTS

GB 2 239 632 * 10/1991

OTHER PUBLICATIONS

Peer Review Presentation made on Mar. 6, 2003, pp. 1-48.
U.S. Appl. No. 60/550,738, filed Mar. 3, 2004, entitled "Sea Vessel Retrieval of Unmanned Underwater Vehicles".

* cited by examiner

*Primary Examiner*—Sherman Basinger
(74) *Attorney, Agent, or Firm*—Jacob Shuster

(57) ABSTRACT

One or more docking cages releasably attached to a tow line extending from the stern of a retrieval ship, emit tracking beacon beams picked up by sensors in unmanned underwater sea craft vehicles being approached, for steered propulsion thereof into rammed hook attachment to the cages. A sea craft vehicle thereby releasably attached to a cage, is towed onboard the retrieval ship by storage reel-in of the tow line, which is then disconnected from the cage and the retrieved vehicle for subsequent use in retrieval of other unmanned sea craft vehicles.

2 Claims, 3 Drawing Sheets

SEA VESSEL RETRIEVAL OF UNMANNED UNDERWATER VEHICLES

CROSS-REFERENCE TO RELATED APPLICATION

This application claims the benefit of U.S. Provisional Application No. 60/550,738 filed Mar. 3, 2004, entitled "SEA VESSEL RETRIEVAL OF UNMANNED UNDERWATER VEHICLES", incorporated herein by reference.

STATEMENT OF GOVERNMENT INTEREST

The invention described herein may be manufactured and used by or for the Government of the United States of America for governmental purposes without the payment of any royalties thereon or therefore.

The present invention relates generally to underwater deployment and retrieval of unmanned sea craft vehicles from underwater locations.

BACKGROUND OF THE INVENTION

Presently there are no facilities available for efficient retrieval of small unmanned sea craft vehicles directly from underwater deployment without use of drogues under control of personnel on the retrieval ship. It is therefore an important object of the present invention to provide for a more rapid retrieval of large numbers of such small unmanned sea craft vehicles by placement thereof onboard the retrieval ship without extensive visual maneuvering of the submerged sea-craft vehicles during the retrieval operations.

SUMMARY OF THE INVENTION

In accordance with the present invention, an elongated flexible tow line is extended from storage in a retrieval ship, with one or more docking devices attached thereto, such as wire cages or spiked spheres. As the retrieval ship is approaching an unmanned vehicle, such as seacraft deployed underwater, a tracking signal beacon is emitted from one of the docking cages attached to the tow line for signal pick-up by a sensor in the underwater vehicle in response to which propulsion and steering of the vehicle toward the towed docking cage is effected. The vehicle is thereby rammed into the tow line at the docking location for attachment thereto. Beacon emission is then shut down in response to signal transmission through the attached tow-line followed by reel in of the tow line into the retrieval ship while bringing the attached vehicle onboard. As each of the vehicles is retrieved onboard, it is disconnected from the tow line which is then reeled into storage and made available for subsequent reuse during repeated retrieval operations.

BRIEF DESCRIPTION OF THE DRAWING

A more complete appreciation of the invention and many of its attendant advantages will be readily appreciated as the same becomes better understood by reference to the following detailed description when considered in connection with the accompanying drawing wherein.

DETAILED DESCRIPTION OF PREFERRED EMBODIMENT

Figure 1:
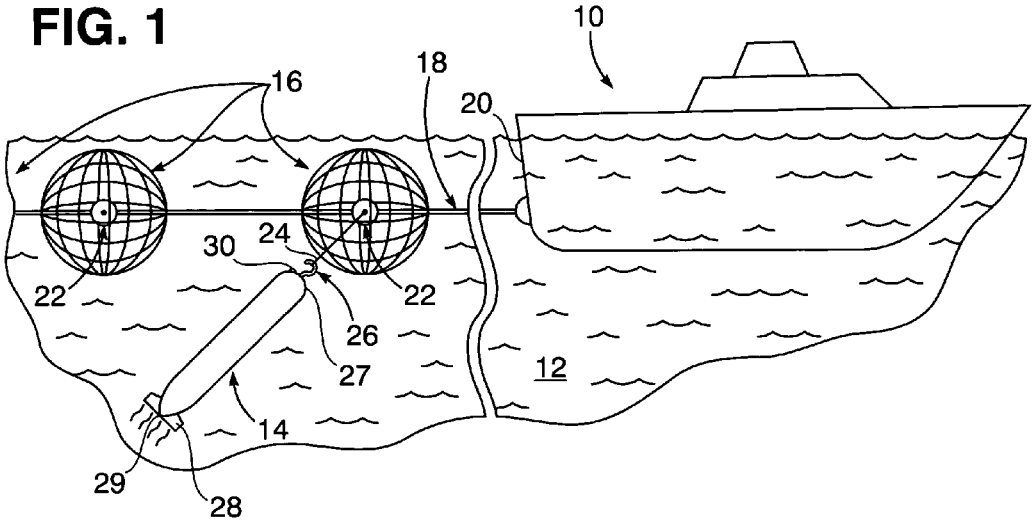
FIG. 1 is a side elevation view of a retrieval ship, with tow line attached beacon emitting docking cages during approach to an unmanned seawater vehicle at an underwater location.

Referring now to the drawing in detail, FIG. 1 illustrates a seawater retrieval ship 10 afloat in a body of seawater 12 adjacent to a relatively smaller self-propelled unmanned sea craft vehicle 14 to be retrieved by personnel on board the retrieval ship 10 from an underwater deployment location within the seawater 12. Pursuant to the present invention, retrieval is effected by use of one or more retrieval docking cages 16 towed underwater by means of a single elongated flexible tow line 18 extending from a stern end 20 of the retrieval ship 10.

Figure 2:
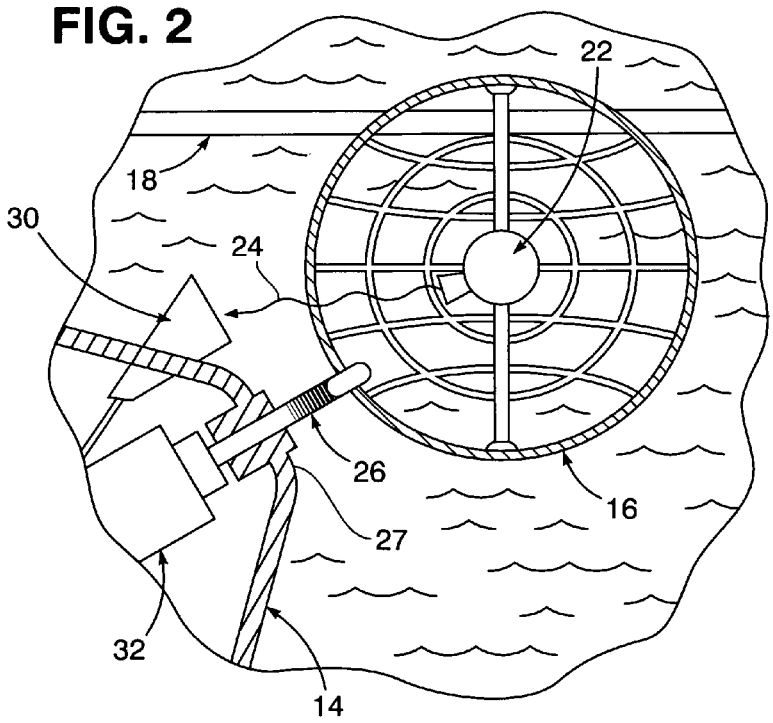
FIG. 2 is a partial section view of one of the cages as shown in FIG. 1, with the approaching seawater vehicle rammed into hooked engagement therewith.
Figure 6:
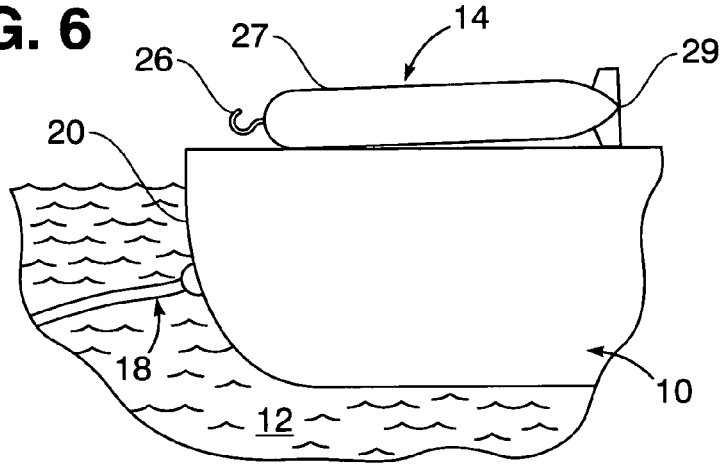
FIG. 6 is a partial side elevation view of the retrieval ship shown in FIG. 1, with the seawater vehicle retrieved onboard thereof.

As shown in FIGS. 1 and 2, each of the cages 16 is a generally spherical shape, made of metallic wires to which the tow line 18 is attached at equally spaced locations behind the stern 20 of the ship 10. Centrally positioned within each of the cages 16 is a single optical beacon emitter 22 from which a tracking signal beacon beam 24 may be dispatched toward the unmanned seawater vehicle 14 to be retrieved. Each of the unmanned underwater vehicles 14 to be retrieved has a docking hook 26 projected in a fixed direction from its forward end 27 opposite a rear end 29 on which propelling blades 28 are mounted. An optical beam receiver 30 projects from the forward end 27 of the vehicle 14 for reception of the beacon signal beam 24 when the cage 16 and the vehicle 14 are approaching each other as shown in FIG. 1, so as to insure propulsion and steering of the vehicle 14 toward the cage 16. When the vehicle 14 rams into the cage 16 during approach to the retrieval ship 10, a hook 26 projecting from the vehicle 14 engages the cage 16 as shown in FIG. 2. The vehicle 14 is then brought onboard the ship 10 as shown in FIG. 6 by reel-in of the tow line 18 connected to the hook 26 as hereinafter explained.

Figure 3:
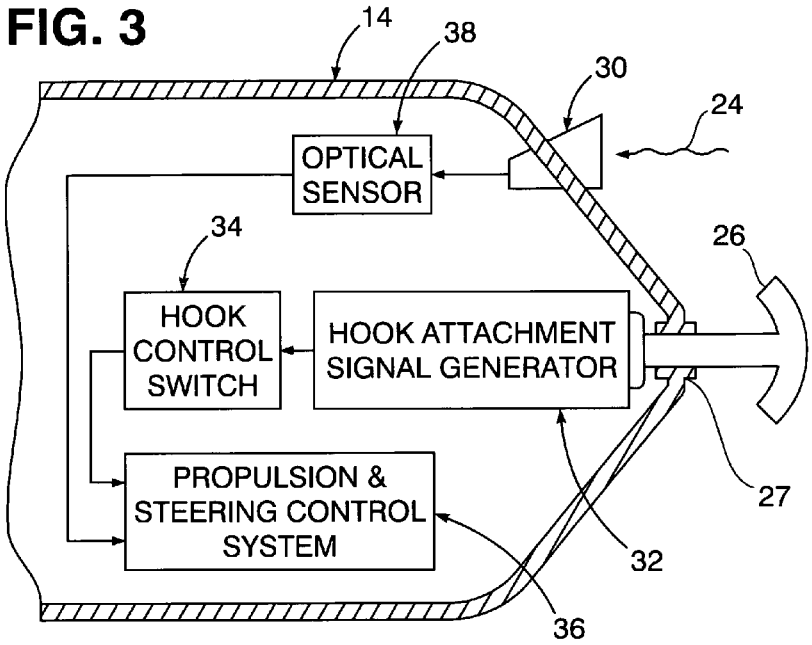
FIG. 3 is a partial section view of the seawater vehicle as shown in FIGS. 1 and 2, with internal control facilities diagrammed therein, for performance of retrieval operations associated with the present invention.

As diagrammed in FIG. 3, the hook 26 projects through the front end 27 of the vehicle 14 from a hook attachment signal generator 32 operationally connected through a hook control switch 34 to a propulsion and steering control system 36 through which the vehicle 14 is propelled and steered toward the retrieval docking cage 16 in response to the signal beam 24 received therefrom through an optical sensor 38 connected to the optical beam receiver 30 on the vehicle 14. Thus upon engagement of the hook 26 with the cage 16, a signal is generated by the generator 32 and applied through the hook control switch 34 to the control system 36 to the system 36 so as to terminate propulsion of the vehicle 14 and accommodate subsequent crane pick-up of the vehicle 14 for placement onboard the ship 10 as shown in FIG. 6.

Figure 4:
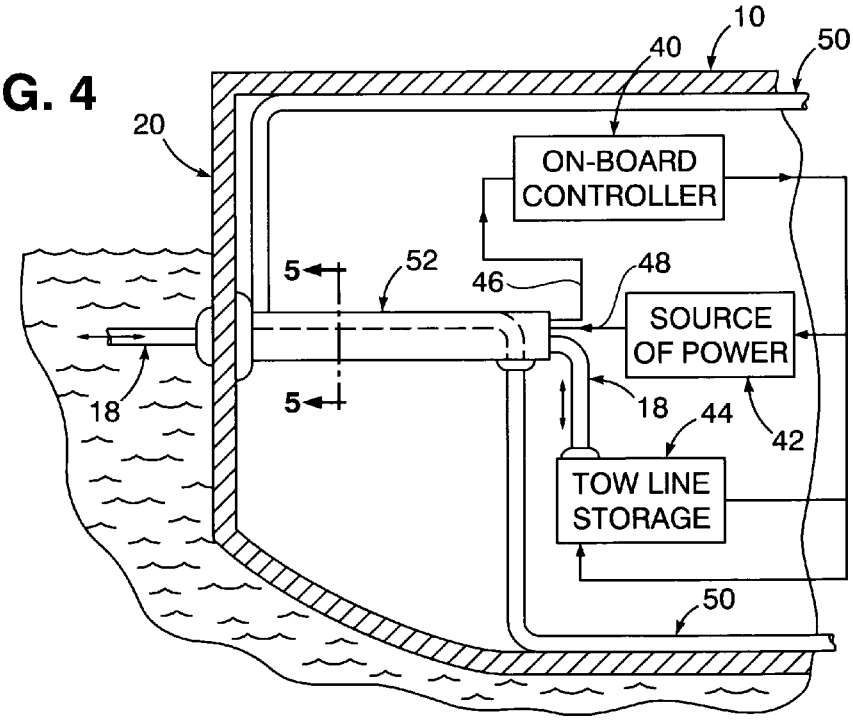
FIG. 4 is a partial section view of a stern end portion of the retrieval ship shown in FIG. 1, with internal control facilities diagrammed therein for performance of the retrieval operations associated with the present invention.
Figure 5:
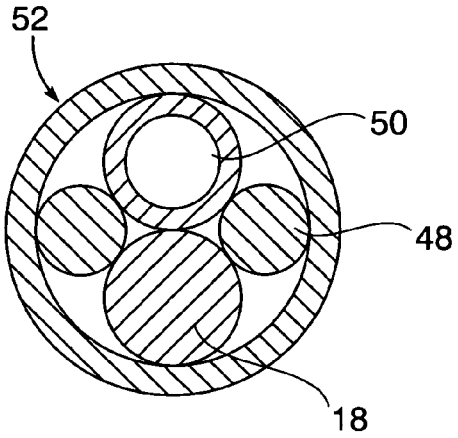
FIG. 5 is a section view taken substantially through a plane indicated by section line 5—5 in FIG. 4.

As diagrammed in FIG. 4, hook engagement signals transmitted through the tow line 18 are received within the ship 10 and are applied through a signal line 46 to an on-board controller 40. Also diagrammed in FIG. 4 is a source of electrical power 42 from which electrical energy is transmitted through a power line 48 and the tow line 18 to the beacon emitter 22 in the docking cage 16 for operation thereof. The tow line 18 when reeled in enters into a storage 44 within the ship 10. The signal line 46 connected to the controller 40, the beacon operation power line 48 extending from the power source 42 and a propulsion fuel line 50 extending from a source of fuel on the ship 10 are enclosed within a multi-purpose cable 52 extending inwardly from the ship stern end 20 as shown in FIGS. 4 and 5. Accordingly, when the cage 16 and the vehicle 14 are brought onboard the ship 10 they are disconnected from the tow line 18. An information signal in the signal line 46 will then be delivered to the on-board controller 40 to shut off the beacon power source 42 connected to the power line 48, and initiate retrieval reel-in of the tow line 18 into the storage 44 during interruption of ship propulsion by cut-off of fuel flow through the fuel line 50.

The foregoing described operations involving hook engagement of the cage 16 with the unmanned seawater vehicles 14, transfer thereof onboard the ship 10, disconnection of the tow line 18 therefrom and storage reel-in of the disconnected tow line 18, is repeated after the tow line 18 is withdrawn from the storage 44 for attachment to other cages 16 through which hook engagement with other unmanned sea craft vehicles 14 occurs. A large number of such vehicles 14 may thereby be quickly and efficiently gathered in a low radar and visual signature environment and towed to a safe area for reeled in retrieval.

As alternatives to the hereinbefore described embodiment utilizing the optical beacons 22, an acoustic beacon may instead be utilized pursuant to the present invention. Also, the wire cages 16 utilized for tow line hook attachment may be replaced by use of spiked spheres with hooks thereon to engage vehicle mounted loops.

Obviously, other modifications and variations of the present invention may be possible in light of the foregoing teachings. It is therefore to be understood that within the scope of the appended claims the invention may be practiced otherwise than as specifically described.

What is claimed is:

1. In combination with a seawater retrieval ship, a system for onboard retrieval of an unmanned sea craft vehicle located at an underwater location adjacent the retrieval ship, comprising: docking means ejected from the retrieval ship for releasable attachment to the vehicle by hooking means when the vehicle is positioned at said underwater location adjacent to the retrieval ship; signal emitting means on said docking means for controllably maneuvering the vehicle to said underwater location; and towing means extending from the docking means for transferring the vehicle releasably attached thereto by the hooking means onboard the retrieval ship; said docking means comprising: at least one cage of a generally spherical shape within which the signal emitting means is mounted emitting the tracking signal received by a steering control sensor within the vehicle to effect steering thereof; said cage having wiring defining an outer surface thereof to which said hooking means releasably attaches the vehicle; said signal emitting means being centrally positioned within the cage.

2. The combination as defined in claim 1, wherein said towing means comprises: an elongated flexible tow line extending from a stern end of the retrieval ship; and storage means within the retrieval ship for reel in of the tow line with the docking means releasably attached thereto from the underwater location.

* * * * *